US010386748B2

(12) United States Patent
Yuasa

(10) Patent No.: US 10,386,748 B2
(45) Date of Patent: Aug. 20, 2019

(54) TRANSFER DEVICE AND IMAGE FORMING APPARATUS THAT SETS CHARGING DEVICE BASED ON LOCATION OF THE TONER BASE LAYER

(71) Applicant: FUJI XEROX CO., LTD., Tokyo (JP)

(72) Inventor: Koichiro Yuasa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/985,708

(22) Filed: May 22, 2018

(65) Prior Publication Data

US 2018/0364617 A1 Dec. 20, 2018

(30) Foreign Application Priority Data

Jun. 15, 2017 (JP) ..... 2017-118001

(51) Int. Cl.

| | |
|---|---|
| ***G03G 15/02*** | (2006.01) |
| ***G03G 15/08*** | (2006.01) |
| ***G03G 15/20*** | (2006.01) |
| ***G03G 15/16*** | (2006.01) |
| *G03G 15/18* | (2006.01) |

(52) U.S. Cl.

CPC ..... *G03G 15/0865* (2013.01); *G03G 15/0216* (2013.01); *G03G 15/0808* (2013.01); *G03G 15/161* (2013.01); *G03G 15/169* (2013.01); *G03G 15/2053* (2013.01); *G03G 15/18* (2013.01)

(58) Field of Classification Search

CPC ..... G03G 15/0865

USPC ..... 399/258

See application file for complete search history.

(56) References Cited

U.S. PATENT DOCUMENTS 5,848,323 A * 12/1998 Umeda ..... G03G 15/2053 399/66

2013/0259502 A1* 10/2013 Motomura ..... G03G 15/0266 399/50

FOREIGN PATENT DOCUMENTS

JP 2006-154381 6/2006

JP 2009294480 A * 12/2009

OTHER PUBLICATIONS

Takehara. Translation of JP2009294480. Published Dec. 2009. Translated Sep. 2018.*

* cited by examiner

*Primary Examiner* — Walter L Lindsay, Jr.
*Assistant Examiner* — Philipmarcus T Fadul
(74) *Attorney, Agent, or Firm* — JCIPRNET

(57) ABSTRACT

A transfer device includes a holding body, a transfer body, and a setting portion. The holding body holds multiple layers including a base layer formed of a toner having a mass larger than a threshold. The toner is electrically charged by a charging device. The transfer body transfers the layers on the holding body to a recording medium. The setting portion sets the charging device so that the charging device electrically charges a toner immediately after being transferred to the holding body with a larger amount of electric charges when the base layer is located uppermost on the holding body, than when the base layer is located other than uppermost on the holding body.

13 Claims, 22 Drawing Sheets

TRANSFER DEVICE AND IMAGE FORMING APPARATUS THAT SETS CHARGING DEVICE BASED ON LOCATION OF THE TONER BASE LAYER

CROSS-REFERENCE TO RELATED APPLICATIONS

This application is based on and claims priority under 35 USC 119 from Japanese Patent Application No. 2017-118001 filed Jun. 15, 2017.

BACKGROUND

Technical Field

The present invention relates to a transfer device and an image forming apparatus.

SUMMARY

According to an aspect of the invention, a transfer device includes a holding body, a transfer body, and a setting portion. The holding body holds multiple layers including a base layer formed of a toner having a mass larger than a threshold. The toner is electrically charged by a charging device. The transfer body transfers the layers on the holding body to a recording medium. The setting portion sets the charging device so that the charging device electrically charges a toner immediately after being transferred to the holding body with a larger amount of electric charges when the base layer is located uppermost on the holding body, than when the base layer is located other than uppermost on the holding body.

BRIEF DESCRIPTION OF THE DRAWINGS

Exemplary embodiments of the present invention will be described in detail based on the following figures, wherein.

DETAILED DESCRIPTION

First Exemplary Embodiment

Examples of a transfer device and an image forming apparatus according to a first exemplary embodiment of the present invention are described with reference to FIGS. 1 to 16. The arrow H shown in these drawings denotes the vertical direction and an apparatus height direction, and the arrow W denotes the horizontal direction and an apparatus width direction.

Entire Structure

Figure 15:
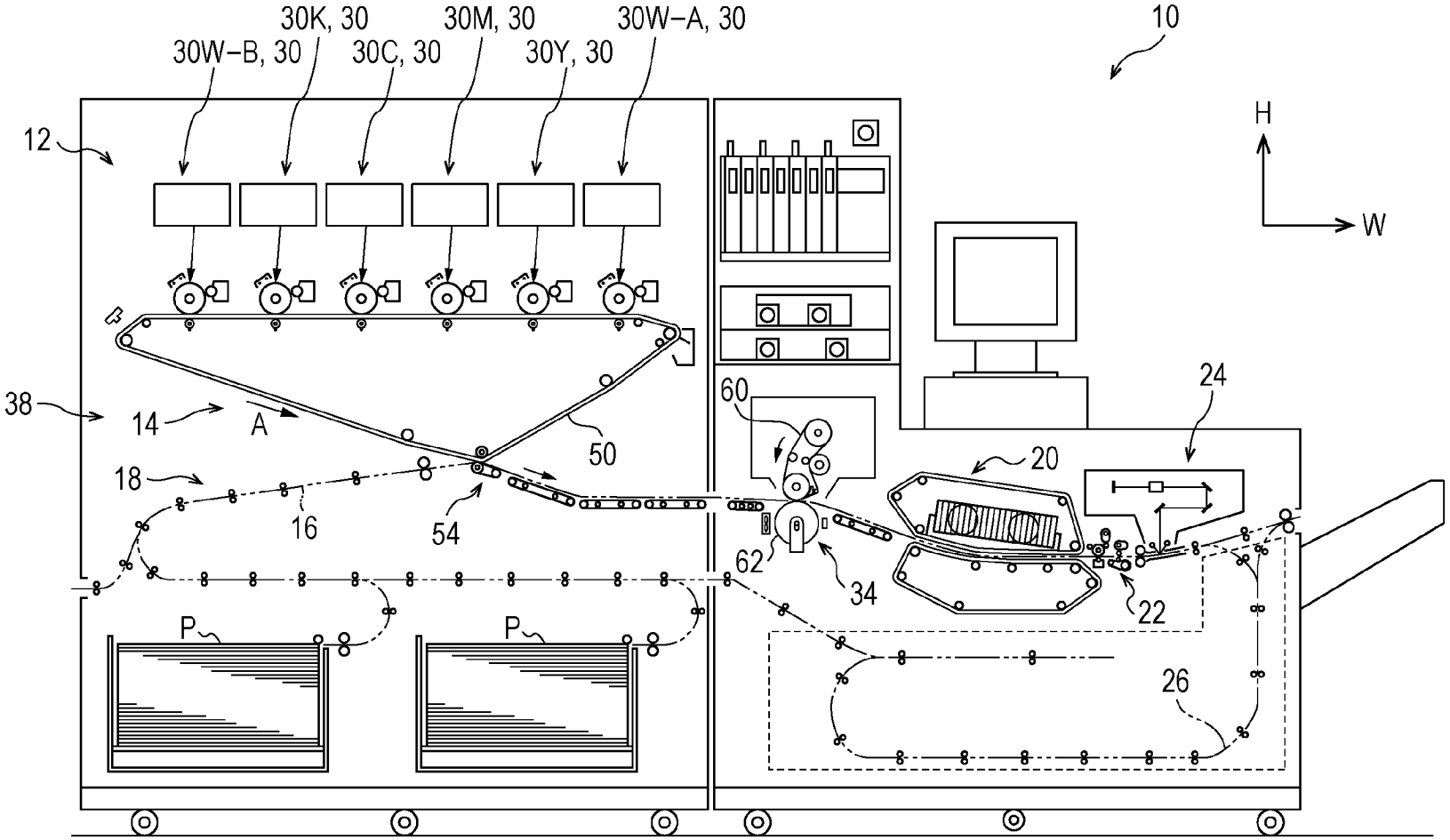
FIG. 15 is a schematic diagram of the structure of the image forming apparatus according to the first exemplary embodiment of the present invention.

As illustrated in FIG. 15, an image forming apparatus 10 includes an image forming unit 12, which forms images by electrophotography, and a transport device 18, which includes multiple transport rollers (not denoted with reference signs), which transport a sheet member P (an example of a recording medium) along a transport path 16 of the sheet member P.

The image forming apparatus 10 includes a cooling portion 20, which cools a sheet member P on which an image is formed, a correcting portion 22, which corrects bending of a sheet member P, and an image inspecting portion 24, which inspects an image formed on a sheet member P.

The image forming apparatus 10 also includes a reverse path 26, which reverses a sheet member P having an image formed on its top surface and transports the sheet member P again toward the image forming unit 12 to form images on both surfaces of the sheet member P.

The image forming apparatus 10 having the above structure forms an image (toner image) formed by the image forming unit 12 on the top surface of a sheet member P transported along the transport path 16. The sheet member P having an image famed thereon passes through the cooling portion 20, the correcting portion 22, and the image inspecting portion 24 in this order to be discharged to the outside of the apparatus.

When an image is to be formed on the back surface of a sheet member P, a sheet member P having an image formed on its top surface is transported along the reverse path 26 and the image forming unit 12 forms an image again on the back surface of the sheet member P.

Image Forming Unit

The image forming unit 12 includes multiple toner layer forming portions 30, which respectively form toner layers of various colors, a transfer belt 50, which holds a toner image formed from one or more toner layers, and a transfer portion 14, which transfers a toner image to a sheet member P. The image forming unit 12 also includes a setting portion 58 (see FIG. 5), which sets an amount of electric charges of the toner of a toner layer transferred to the transfer belt 50, and a fixing device 34, which fixes a toner image transferred to a sheet member P by the transfer portion 14 onto the sheet member P.

The multiple toner layer forming portions 30 form toner layers of different colors. In the present exemplary embodiment, the toner layer forming portions 30 are prepared for five colors of yellow (Y), magenta (M), cyan (C), black (K), and white (W). Reference characters Y, M, C, K, and W appended to the reference numerals in FIG. 15 represent the above colors. In the present exemplary embodiment, yellow (Y), magenta (M), cyan (C), and black (K) are basic colors to output a color image. Two toner layer forming portions 30 are prepared for white (W).

In the following description, the characters Y, M, C, K, and W appended to the reference numerals are omitted unless yellow (Y), magenta (M), cyan (C), black (K), and white (W) need to be distinguished from each other. Hereinbelow, yellow (Y), magenta (M), cyan (C), and black (K) may be collectively referred to as "non-white colors".

Figure 14:
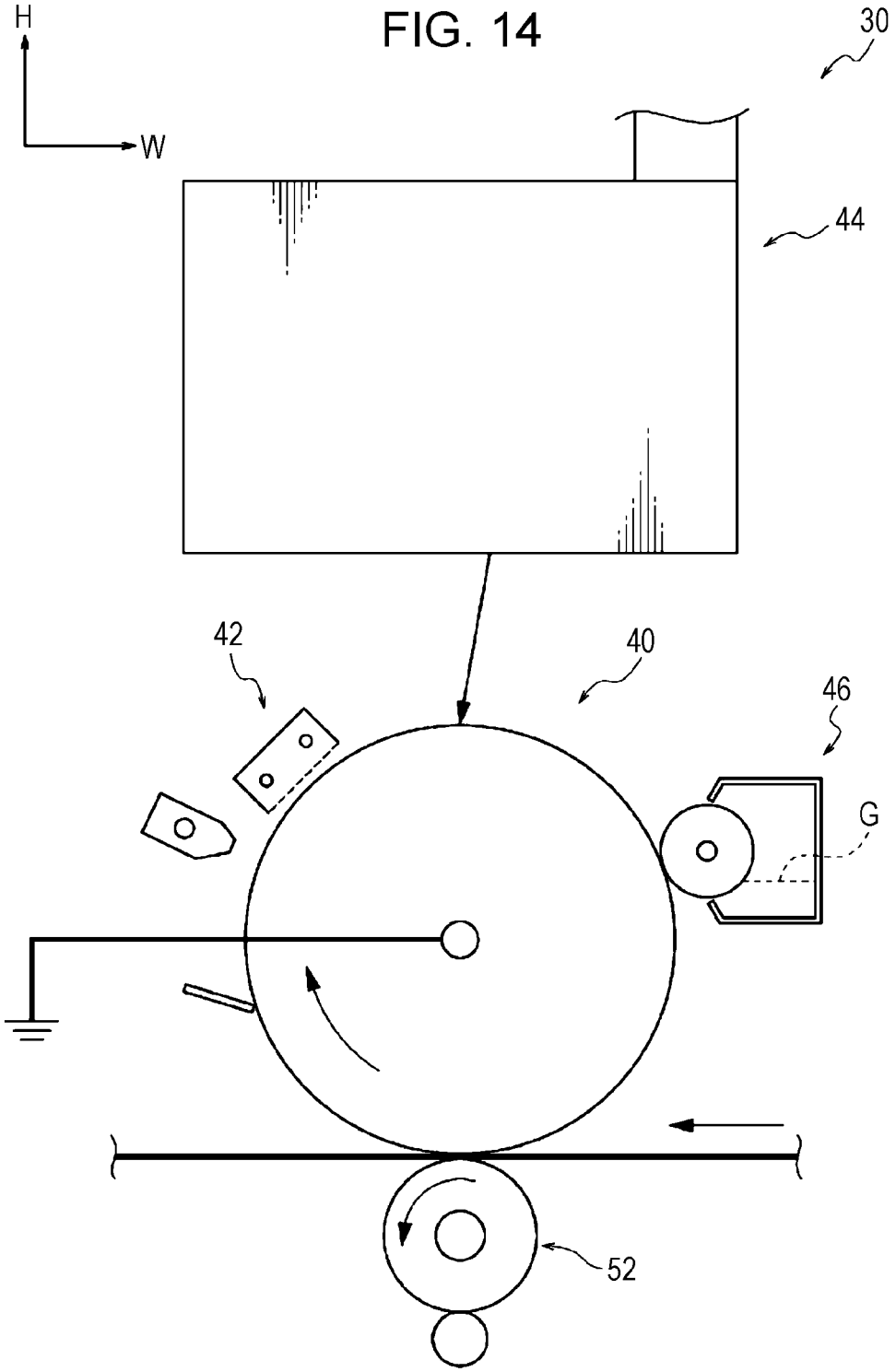
FIG. 14 illustrates a structure of a toner layer forming portion of the image forming apparatus according to the first exemplary embodiment of the present invention.

The toner layer forming portions 30 for various colors basically have the same structure except for using different color toners. As illustrated in FIG. 14, each toner layer forming portion 30 includes a rotating cylindrical image carrier 40, and a charging device 42, which charges the image carrier 40. Each toner layer forming portion 30 also includes an exposure device 44, which irradiates the charged image carrier 40 with exposure light to form an electrostatic latent image on the image carrier 40, and a developing device 46, which develops an electrostatic latent image with a developer G containing a toner into a toner layer. Here, the developer G used in the present exemplary embodiment is a binary developer containing a toner and a carrier.

Figure 1:
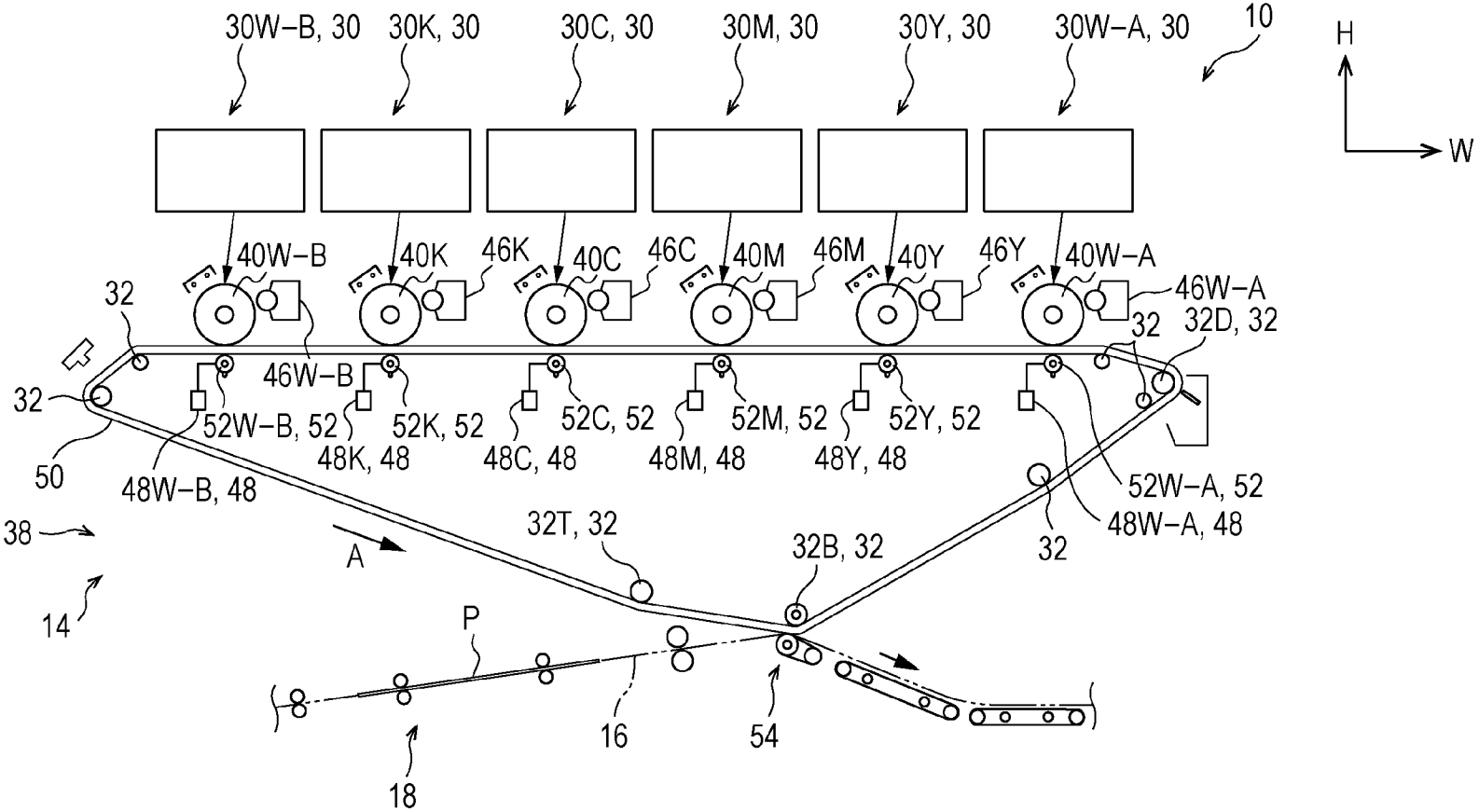
FIG. 1 illustrates a structure of, for example, toner layer forming portions of an image forming apparatus according to a first exemplary embodiment of the present invention.

Each image carrier 40 for the corresponding color is grounded and touches the rotating transfer belt 50 (described in detail below). As illustrated in FIG. 1, the toner layer forming portions 30 for white (W), yellow (Y), magenta (M), cyan (C), black (K), and white (W) are arranged in this order in the horizontal direction from the upstream side in the direction in which the transfer belt 50 is rotated (see the arrow A in the drawing).

The toner layer forming portion 30W disposed on the upstream side of the non-white color toner layer forming portions 30Y, 30M, 30C, and 30K in the sheet transport direction may be also referred to as a "toner layer forming portion 30W-A" for illustration convenience. On the other hand, the toner layer forming portion 30W disposed on the downstream side of the non-white color toner layer forming portions 30Y, 30M, 30C, and 30K in the sheet transport direction may be also referred to as a "toner layer forming portion 30W-B" for illustration convenience.

As illustrated in FIG. 1, the transfer portion 14 includes first transfer rollers 52 of different colors, which transfer toner layers formed on the image carriers 40 of the corresponding colors to the transfer belt 50. The transfer portion 14 also includes a second transfer portion 54, which transfers a toner image formed from one or more toner layers transferred to the transfer belt 50 onto a sheet member P. The transfer portion 14, the transfer belt 50, voltage application members 48, which apply a transfer voltage to the first transfer rollers 52 of the transfer portion 14, and the setting portion 58 are described in detail, below.

As illustrated in FIG. 15, the fixing device 34 includes a fixing belt 60, which is wound around multiple rollers (not denoted with reference signs) and heated, and a pressing roller 62, which presses a sheet member P against the fixing belt 60. In this structure, the rotating fixing belt 60 and the pressing roller 62 transport a sheet member P, on which a toner image has been transferred, by holding the sheet member P therebetween to fix the toner image onto the sheet member P.

Structure of Related Portions

The following describes toners used in the developing devices 46, the transfer belt 50, serving as an example of a holding body, the transfer portion 14, serving as an example of a transfer body, the voltage application members 48 (see FIG. 1), which apply a transfer voltage to the first transfer rollers 52 described above, and the setting portion 58 (see FIG. 5). The transfer belt 50, the transfer portion 14, the voltage application members 48, and the setting portion 58 are included in a transfer device 38.

Toners Used in Developing Devices 46

The developing devices 46W-A and 46W-B employ a white toner 200 (also referred to as "a W toner", below), and the developing devices 46Y, 46M, 46C, and 46K employ color toners 300 for non-white colors. Now, the white toner 200 and the color toners 300 are described.

The white toner 200 is used on the sheet member P as a base coat for non-white colors. Specifically, a solid layer (solid image) of the white toner 200 is formed on a sheet member P as a base coat for non-white colors to enhance color reproduction of the toner image.

Figure 8A:
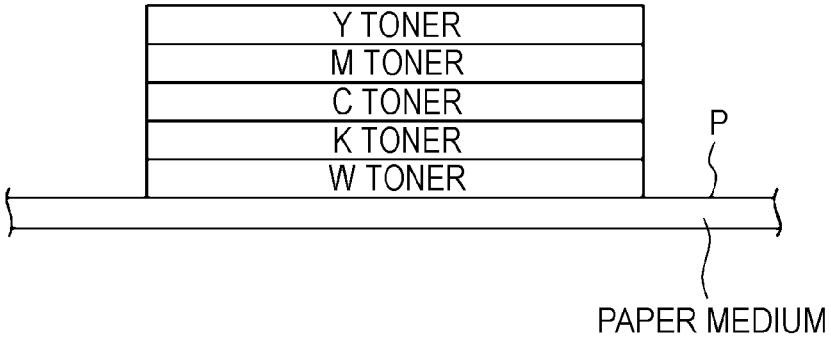
FIGS. 8A and 8B are schematic diagrams of a toner layer superposed on a sheet member used in the image forming apparatus according to the first exemplary embodiment of the present invention.

When the sheet member P is a paper medium, a W toner layer, a K toner layer, a C toner layer, a M toner layer, and a Y toner layer are superposed one on top of another in this order on the sheet member P, which is a paper medium (see FIG. 8A). When, on the other hand, the sheet member P is a transparent film, a K toner layer, a C toner layer, a M toner layer, a Y toner layer, and a W toner layer are superposed one on top of another in this order on the sheet member P to allow an image to be viewed through the film (see FIG. 8B).

White Toner 200

Figure 9A:
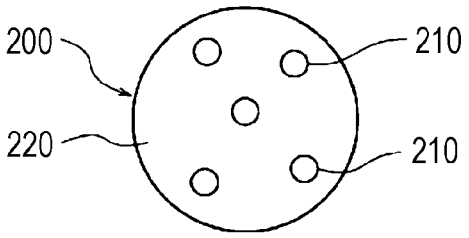
FIGS. 9A and 9B are schematic diagrams of a white toner and a color toner used in the image forming apparatus according to the first exemplary embodiment of the present invention.

As illustrated in FIG. 9A, the white toner 200 contains a spherical pigment 210 and a binding resin 220. The spherical pigment 210 is formed from a titanium oxide (an example of a metallic oxide). The binding resin 220 is formed from a known resin material. The binding resin 220 is less electrically conductive than the spherical pigment 210.

Figure 10A:
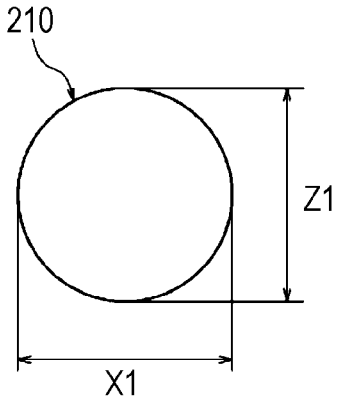
FIGS. 10A and 10B are schematic diagrams of a pigment of a white toner used in the image forming apparatus according to the first exemplary embodiment of the present invention.
Figure 10B:
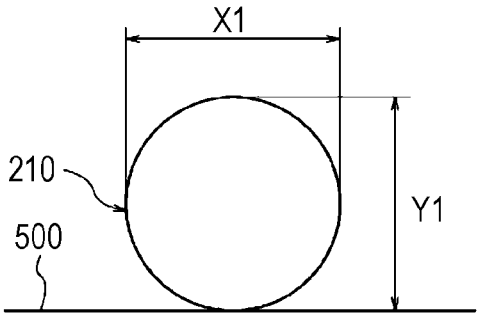

In the state where the spherical pigment 210 is placed on a flat surface 500, a lateral dimension X1 and a front-rear dimension Z1 of the spherical pigment 210, viewed from the top in FIG. 10A, are equal to the lateral dimension X1 and a vertical dimension Y1 of the spherical pigment 210, viewed from the side in FIG. 10B.

Figure 11A:
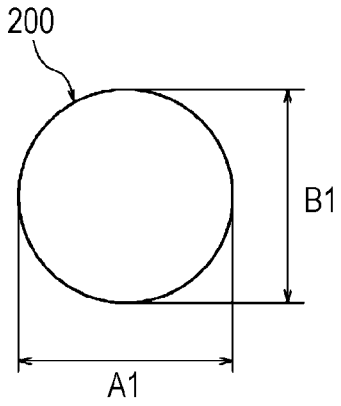
FIGS. 11A and 11B are schematic diagrams of a white toner used in the image forming apparatus according to the first exemplary embodiment of the present invention.
Figure 11B:
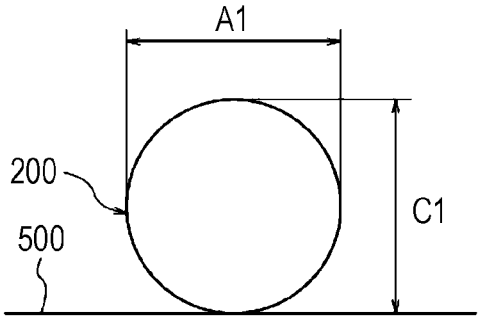

The white toner 200 containing the spherical pigment 210 is also spherical in the same manner as the spherical pigment 210. Thus, when the white toner 200 is placed on the flat surface 500, a lateral dimension A1 and a front-rear dimension B1 of the white toner 200, viewed from the top in FIG. 11A, are equal to the lateral dimension A1 and a vertical dimension C1 of the white toner 200, viewed from the side in FIG. 11B.

The volumetric average particle diameter of the spherical pigment 210 or the white toner 200 is measured by using, for example, Coulter counter TAII (from Nikkaki Bios Co., Ltd.) or multisizer II (from Nikkaki Bios Co., Ltd.). Specifically, within a particle range (channel) separated on the basis of the particle size distribution measured with this measuring instrument, the cumulative distribution is plotted from the smaller diameter with respect to the volume, and the particle diameter (D50v) of the cumulative percentage of 50% is used as a volumetric average particle diameter. Other volumetric average particle diameters below are measured similarly.

The standard volumetric average particle diameter of the spherical pigment 210 falls within a range of approximately 200 nm to 300 nm. The standard volumetric average particle diameter of the white toner 200 falls within a range of approximately 4 μm to 14 μm.

In the present exemplary embodiment, the volumetric average particle diameter of the white toner 200 is 8.5 μm, and the specific gravity of the white toner 200 is 1.6 g/cm$^3$. Thus, the average mass (an example of mass) of the white toner 200 is $0.51\times10^{-9}$ g.

Color Toner 300

Figure 9B:
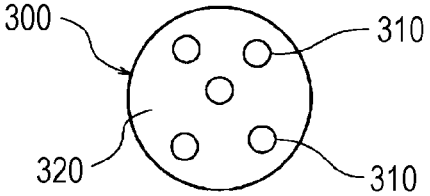

As illustrated in FIG. 9B, each color toner 300 does not contain the spherical pigment 210. The color toner 300 contains a pigment 310, different from the spherical pigment 210, and a binding resin 320. The pigment 310 is formed of, for example, a nonmetal and nonmetallic oxide pigment (for example, an organic pigment). Specifically, the color toner 300 contains a pigment less electrically conductive than the spherical pigment 210. The binding resin 320 is formed of a known resin material.

Figure 12A:
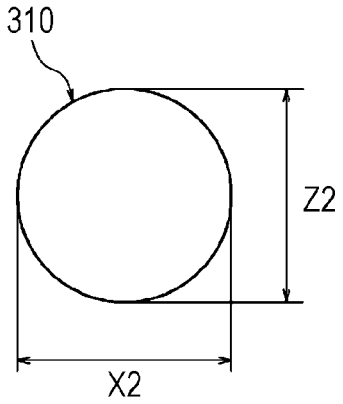
FIGS. 12A and 12B are schematic diagrams of a pigment of a color toner used in the image forming apparatus according to the first exemplary embodiment of the present invention.
Figure 12B:
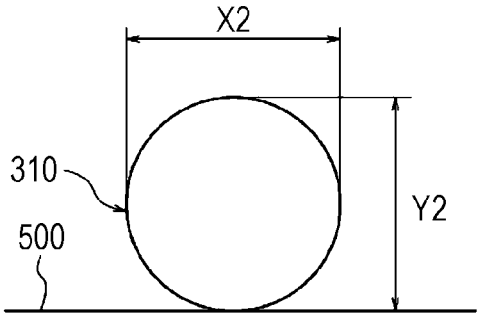

In the state where the spherical pigment 310 is placed on the flat surface 500, a lateral dimension X2 and a front-rear dimension Z2 of the spherical pigment 310, viewed from the top in FIG. 12A, are equal to the lateral dimension X2 and a vertical dimension Y2 of the spherical pigment 310, viewed from the side in FIG. 12B. Specifically, the pigment 310 is approximately spherical.

Figure 13A:
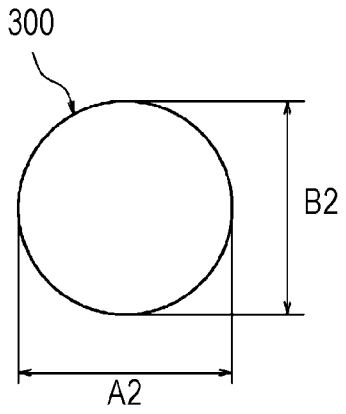
FIGS. 13A and 13B are schematic diagrams of a color toner used in the image forming apparatus according to the first exemplary embodiment of the present invention.
Figure 13B:
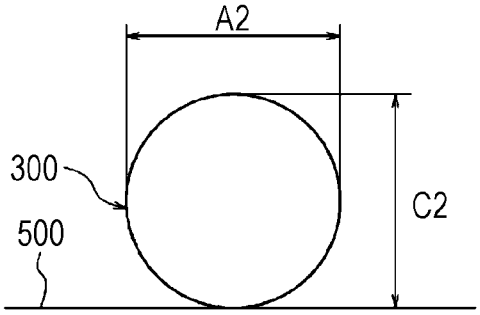

Similarly to the pigment 310, the color toner 300 containing the pigment 310 is also spherical. Thus, when the color toner 300 is placed on the flat surface 500, a lateral dimension A2 and a front-rear dimension B2 of the color toner 300, viewed from the top in FIG. 13A, are equal to the lateral dimension A2 and a vertical dimension C2 of the color toner 300 viewed from the side in FIG. 13B.

The volumetric average particle diameter of the pigment 310 falls within the range of approximately 50 nm to 150 nm. The volumetric average particle diameter of the color toner 300 falls within the range of 3 μm to 9 μm. When the volumetric average particle diameter exceeds 9 μm, the image may have a low resolution. On the other hand, when the volumetric average particle diameter falls below 3 μm, the toner may be charged insufficiently, and the developed image may have low quality.

As described above, the color toner 300 includes a spherical pigment 210, less electrically conductive than the spherical pigment 210 of the white toner 200. Thus, the color toner 300 is more easily charged than the white toner 200. Specifically, the color toner 300 has higher chargeability (electric-charge bearability) than the white toner 200. In other words, the white toner 200 has lower chargeability than the color toner 300.

Here, in the present exemplary embodiment, for each of the Y toner, the M toner, and the C toner, a toner having a specific gravity of 1.1 g/cm$^3$ and a volumetric average particle diameter of 4.7 μm is used. For the K toner, a toner having a specific gravity of 1.2 g/cm$^3$ and a volumetric average particle diameter of 4.7 μm is used. Thus, the Y toner, the M toner, and the C toner have a mass of $0.6\times10^{-10}$ g, and the K toner has a mass of $0.65\times10^{-10}$ g.

The color toner 300 may contain a compound formed from a divalent or polyvalent metallic element. The compound is added as, for example, a coagulant to form the color toner 300 by emulsion polymerization aggregation. The content of the compound in the color toner 300 falls within a range of, for example, 0.05 percent by mass to 2 percent by mass.

Transfer Belt 50

As illustrated in FIG. 1, the transfer belt 50 is endless and wound around multiple rollers 32. The transfer belt 50 is in a position of an inverted obtuse triangle, long in the apparatus width direction in a front view. In the present exemplary embodiment, the transfer belt 50 is made of a material obtained by dispersing carbon in polyimide. The transfer belt 50 has a volume resistivity of 12.5 log ohm-cm.

Transfer Portion 14

The transfer portion 14 includes multiple rollers 32, around which the transfer belt 50 is wound, and first transfer rollers 52 for various colors, which transfer the toner layers formed on the image carriers 40 for the various colors to the transfer belt 50. The transfer portion 14 also includes a second transfer portion 54, which transfers the toner image transferred to the transfer belt 50 to the sheet member P.

Rollers 32

Multiple rollers 32 include a roller 32D disposed on a first end (on the right side) in the apparatus width direction. The roller 32D rotates the transfer belt 50 in the direction of arrow A (counterclockwise in the drawing) with a rotational force transmitted from a motor, not illustrated. In the present exemplary embodiment, the roller 32D is a cylindrical metal roller having an outer diameter of 28 mm.

The multiple rollers 32 include a roller 32B, around which the lower end vertex forming an obtuse angle of the transfer belt 50 taking an obtuse triangle position is wound. The roller 32B faces the second transfer portion 54 with the transfer belt 50 interposed therebetween. A transfer voltage is applied to the roller 32B. In the present exemplary embodiment, the roller 32B is an elastic roller having an outer diameter of 28 mm. The roller 32B has a surface resistance of 7.3 log ohm/sq. The roller 32B has a surface hardness of 53 degrees in Asker C hardness.

The multiple rollers 32 include a roller 32T on the upstream side of and adjacent to the roller 32B in the direction in which the transfer belt 50 rotates (hereinafter referred to as "a belt rotation direction"). The roller 32T applies a tension to the transfer belt 50. Specifically, a slope portion of the transfer belt 50 is wound around the roller 32T. The slope portion of the transfer belt 50 tilts from the horizontal direction. In the present exemplary embodiment, the roller 32T is a cylindrical metal roller having an outer diameter of 28 mm.

First Transfer Rollers 52

As illustrated in FIG. 1, the first transfer rollers 52 are disposed so as to face the image carriers 40 of the respective colors with the transfer belt 50 interposed therebetween. In the present exemplary embodiment, the first transfer rollers 52 are elastic rollers having an outer diameter of 28 mm. The first transfer rollers 52 have a resistance of 7.71 log ohm and the first transfer rollers 52 have a surface hardness of 30 degrees in Asker C hardness. The first transfer roller 52W-A is an example of a second transfer body and the first transfer roller 52W-B is an example of a first transfer body.

Second Transfer Portion 54

Figure 2:
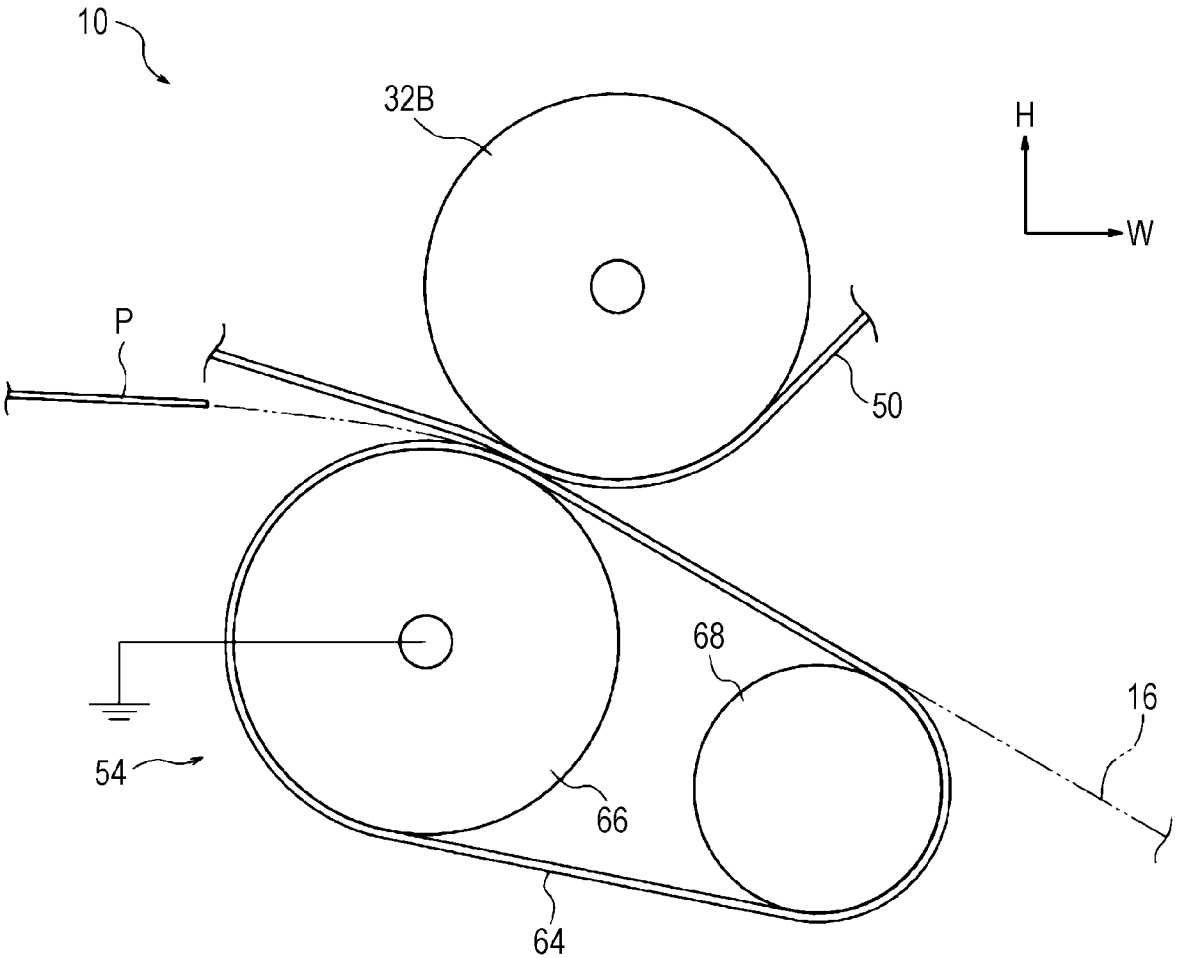
FIG. 2 is a sectional view of components, such as a second transfer portion and a transfer belt, of the image forming apparatus according to the first exemplary embodiment of the present invention.

As illustrated in FIG. 2, the second transfer portion 54 includes an endless elastic belt 64, and rollers 66 and 68, around which the elastic belt 64 is wound.

In the present exemplary embodiment, the elastic belt 64 is a rubber belt having a thickness of 450 μm and a perimeter of 40 mm. The elastic belt 64 has a volume resistance of 9.2 log ohm.

The roller 66 is grounded and disposed so as to hold the transfer belt 50 and the elastic belt 64 between the roller 66 and the roller 32B. In the present exemplary embodiment, the roller 66 is an elastic roller having an outer diameter of 28 mm. The roller 66 has a resistance of 6.3 log ohm.

The roller 68 is located on the downstream side of the roller 66 in the direction in which the sheet member P is transported along the transport path 16 (hereinafter referred to as "a sheet transport direction"). In the present exemplary embodiment, the roller 68 is a cylindrical metal roller having an outer diameter of 20 mm.

In this structure, a sheet member P transported while being held between the transfer belt 50 and the second transfer portion 54 is pressed against the transfer belt 50. When a transfer voltage is applied to the roller 32B, a transfer electric field is formed between the roller 32B and the roller 66 of the second transfer portion 54. This transfer electric field transfers the toner image on the transfer belt 50 to the sheet member P that is being transported.

Voltage Application Members 48

As illustrated in FIG. 1, the voltage application members 48 are disposed to apply a transfer voltage to the first transfer rollers 52 of the respective colors. A voltage application member 48W-A is an example of a second voltage application member, and a voltage application member 48W-B is an example of a first voltage application member.

In this structure, when each voltage application member 48 applies a transfer voltage to the corresponding first transfer roller 52, a transfer electric field is formed between the first transfer roller 52 and the image carrier 40. The toner layer on the image carrier 40 is thus transferred to the transfer belt 50 with the transfer electric field, and the transfer belt 50 holds the toner image formed from one or more toner layers.

Setting Portion 58

The setting portion 58 sets the amount of electric charges of the toner so that a toner immediately after being transferred to the transfer belt 50 is electrically charged with a larger amount of electric charges when a base layer formed of a toner having a mass equal to or larger than a threshold is located uppermost on the transfer belt 50, than when a base layer formed of a toner having a mass equal to or larger than a threshold is located other than uppermost on the transfer belt 50.

Specifically, the setting portion 58 sets the amount of electric charges of the toner immediately after a base layer located uppermost on the transfer belt 50 is transferred to the transfer belt 50 (referred to as "first amount of electric charges", below) to be larger than the amount of electric charges of the toner immediately after a base layer located other than uppermost on the transfer belt 50 is transferred to the transfer belt 50 (referred to as "second amount of electric charges", below).

In the present exemplary embodiment, the threshold of the mass of the toner (toner particles) is set at, for example, $0.2\times10^{-9}$ g.

Thus, the base layer located uppermost on the transfer belt 50 is a toner layer formed of a W toner transferred to the transfer belt 50 by the first transfer roller 52W-B. On the other hand, the base layer located other than uppermost on the transfer belt 50 is a toner layer formed of a W toner transferred to the transfer belt 50 by the first transfer roller 52W-A. Specifically, the "base layer" refers to the W toner layer in the present exemplary embodiment.

In addition, "the amount of electric charges of the toner of the W toner layer immediately after being transferred to the transfer belt 50" refers to the amount of electric charges of the toner of the toner layers transferred to the transfer belt 50 by the first transfer rollers 52W-A and 52W-B in the state of not being affected by the transfer electric field of other first transfer rollers 52. Specifically, the amount of electric charges of the toner of the W toner layer transferred by the first transfer roller 52W-A is an amount of electric charges of the toner of the toner layer before the toner layer enters a space (transfer nip) between the image carrier 40Y and the first transfer roller 52Y.

The amount of electric charges μC/g of the toner on the transfer belt 50 may be detected by using a known technology. For example, the amount of electric charges of the toner may be measured by a charge/particle-size spectrometer (E-SPART ANALYZER) from HOSOKAWA MICRON CORPORATION. The amount of electric charges per unit mass may be measured by a blow-off measurement system, instead. In the present exemplary embodiment, the amount of electric charges is measured by the E-SPART method.

Hereinbelow, which device the setting portion 58 specifically controls to render the first amount of electric charges larger than the second amount of electric charges is described.

To render the first amount of electric charges larger than the second amount of electric charges, the setting portion 58 sets the voltage application members 48W-A and 48W-B so that the transfer voltage applied to the first transfer roller 52W-B is larger than the transfer voltage applied to the first transfer roller 52W-A.

A voltage substantially equal to the transfer voltage applied to the first transfer roller 52W-A is constantly applied to the first transfer rollers 52Y, 52M, 52C, and 52K.

When the base layer is located uppermost on the transfer belt 50, the amount of electric charges of the toner of the base layer immediately before the base layer is transferred to the sheet member P by the second transfer portion 54 is a third amount of electric charges. When the base layer is located other than uppermost on the transfer belt 50, the amount of electric charges of the toner of the base layer immediately before the base layer is transferred to the sheet member P by the second transfer portion 54 is a fourth amount of electric charges.

When the setting portion 58 sets the first amount of electric charges to be larger than the second amount of electric charges, the setting portion 58 sets the voltage application members 48W-A and 48W-B so that the third amount of electric charges is substantially equal to the fourth amount of electric charges.

Here, "the amount of electric charges of the toner of the base layer immediately before the base layer is transferred to the sheet member P" is the amount of electric charges of the toner of the toner layer transferred to the transfer belt 50 after being affected by the transfer electric field of other first transfer rollers 52 and before being transferred to the sheet member P by the second transfer portion 54. Specifically, the amount of electric charges of the toner of the base layer transferred to the first transfer roller 52W-A is an amount of electric charges of the toner after the toner has passed through the space between the image carriers 40Y, 40M, 40C, 40K, and 40W-B and the first transfer rollers 52Y, 52M, 52C, 52K, and 52W-B.

The state where "the third amount of electric charges is substantially equal to the fourth amount of electric charges" is the state where the third amount of electric charges falls within the range of ±10% of the fourth amount of electric charges.

Evaluations

Now, the effects of the image forming apparatus 10 are described in comparison with an image forming apparatus 910 according to a comparative example. Firstly, the structure of the image forming apparatus 910 according to a comparative example, particularly, the portions of the image forming apparatus 910 according to a comparative example that differ from those of the image forming apparatus 10 according to the present exemplary embodiment are described. Then, the effects of the image forming apparatus 910 according to the comparative example and the image forming apparatus 10 according to the present exemplary embodiment are described.

Image Forming Apparatus 910 According to Comparative Example

Figure 16:
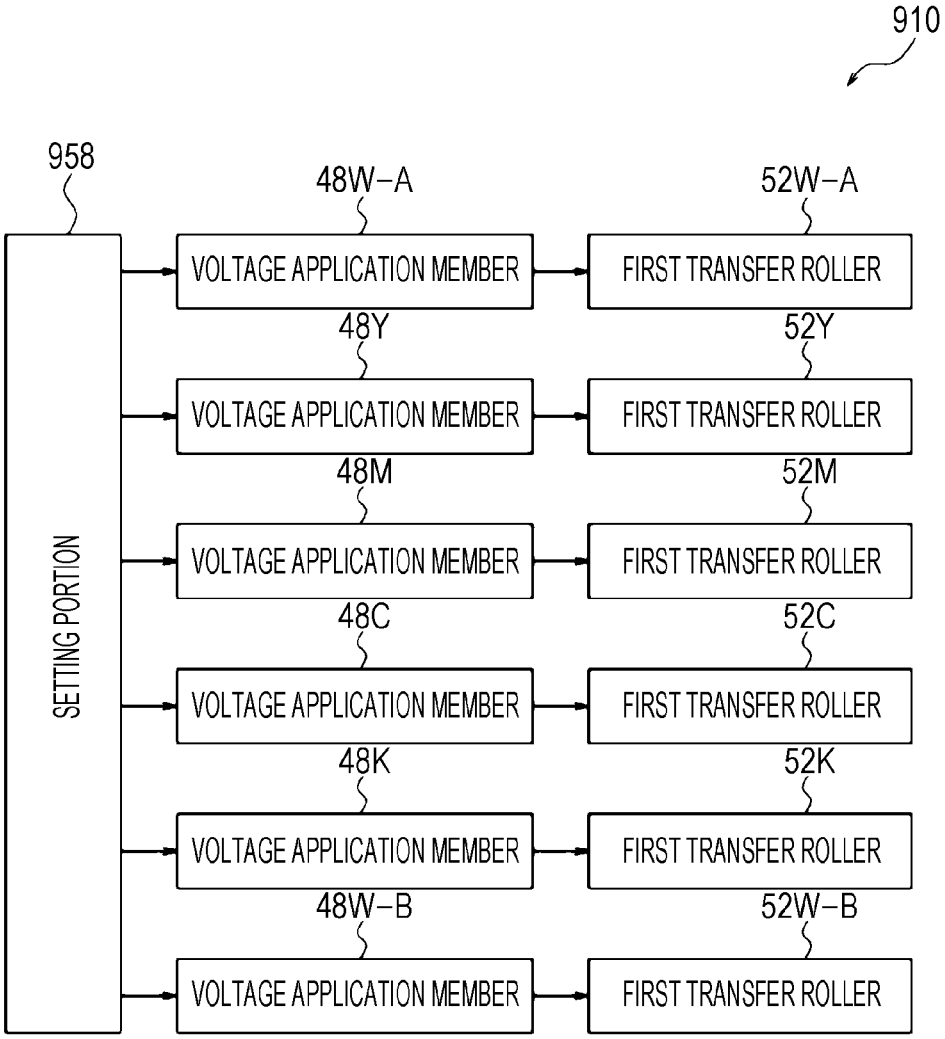
FIG. 16 is a block diagram of a setting configuration of a setting portion of an image forming apparatus according to a comparative example, compared with the image forming apparatus according to the first exemplary embodiment of the present invention.

As illustrated in FIG. 16, a setting portion 958 of the image forming apparatus 910 according to the comparative example sets the transfer voltage applied to the first transfer rollers 52 through the voltage application members 48.

Regardless of the mass of a toner, the setting portion 958 sets the voltage application members 48W-A and 48W-B to apply, to the first transfer rollers 52W-A and 52W-B, the transfer voltage substantially equal to the transfer voltage that the image forming apparatus 10 applies to the first transfer roller 52W-A. Specifically, the image forming apparatus 910 constantly applies, to the first transfer rollers 52W-A, 52Y, 52M, 52C, 52K, and 52W-B, the transfer voltage substantially equal to the transfer voltage that the image forming apparatus 10 applies to the first transfer roller 52W-A.

Thus, in the image forming apparatus 910, the above-described first amount of electric charges is substantially equal to the second amount of electric charges.

Effects of Image Forming Apparatus 910 and Image Forming Apparatus 10

Now, the case where the image forming apparatus 910 having the above structure outputs an image using the toner layer forming portions 30Y, 30M, 30C, 30K, and 30W-B is described.

Figure 7:
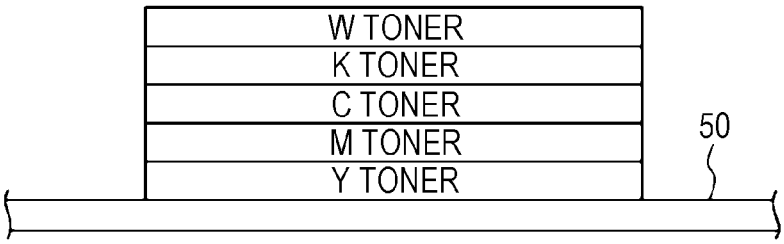
FIG. 7 is a schematic diagram of a toner layer superposed on the transfer belt of the image forming apparatus according to the first exemplary embodiment of the present invention.

When the toner layer forming portions 30Y, 30M, 30C, 30K, and 30W-B (see FIG. 1) transfer toner layers to the transfer belt 50, a toner image formed by superposing a Y toner layer, a M toner layer, a C toner layer, a K toner layer, and a W toner layer in order is formed (held) on the transfer belt 50, as illustrated in FIG. 7.

Figure 3A:
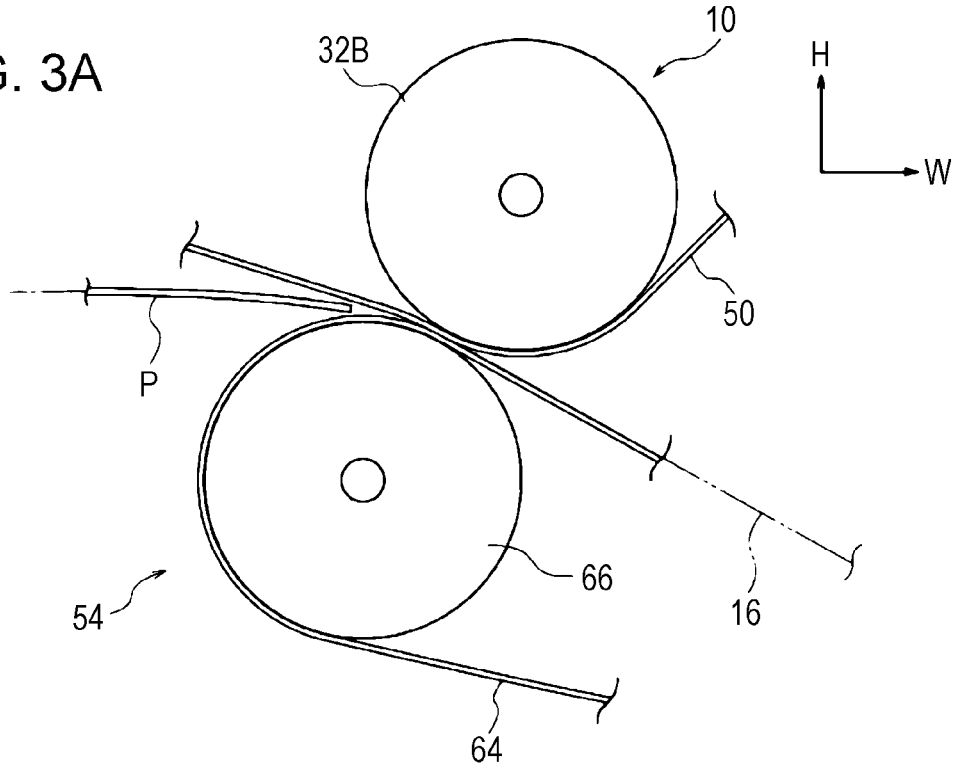
FIGS. 3A and 3B are sectional views of components, such as the second transfer portion and the transfer belt, of the image forming apparatus according to the first exemplary embodiment of the present invention.
Figure 3B:
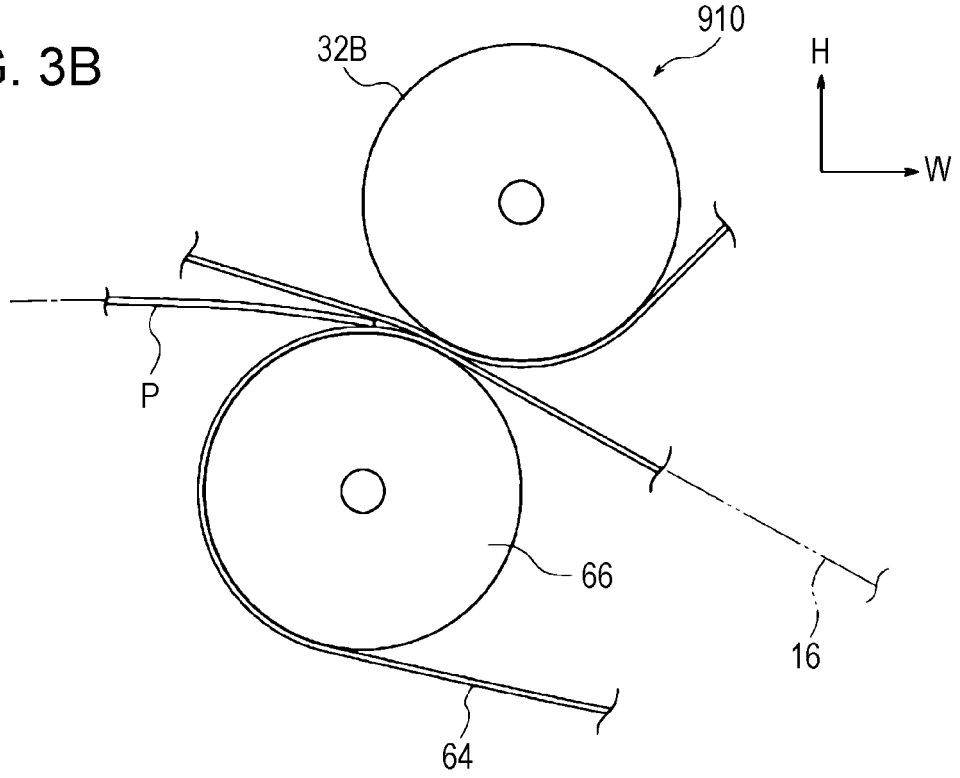
Figure 4A:
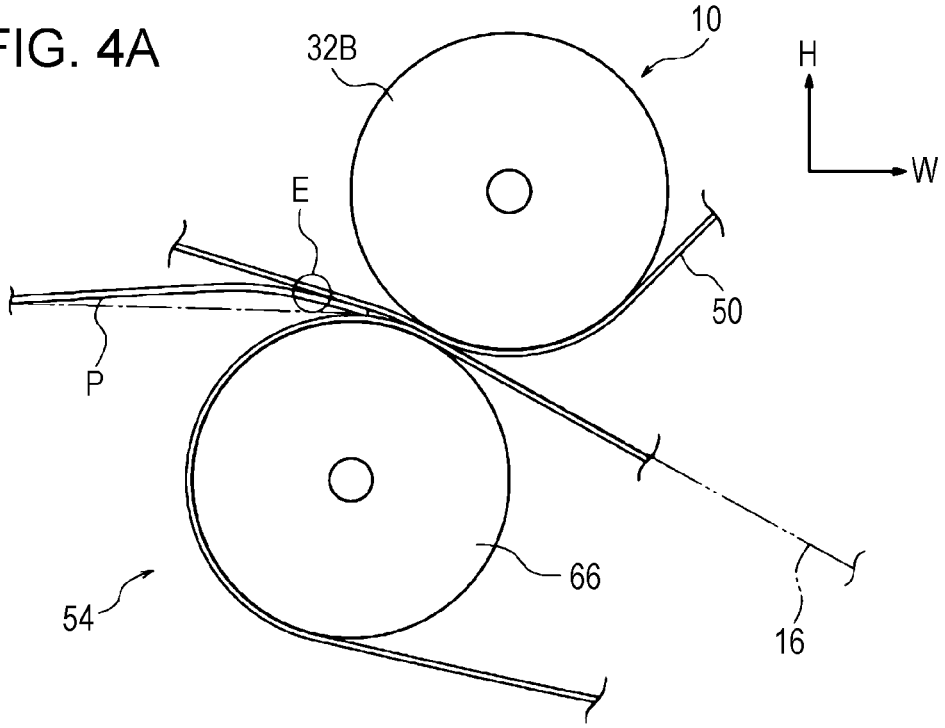
FIGS. 4A and 4B are sectional views of components, such as the second transfer portion and the transfer belt, of the image forming apparatus according to the first exemplary embodiment of the present invention.
Figure 4B:
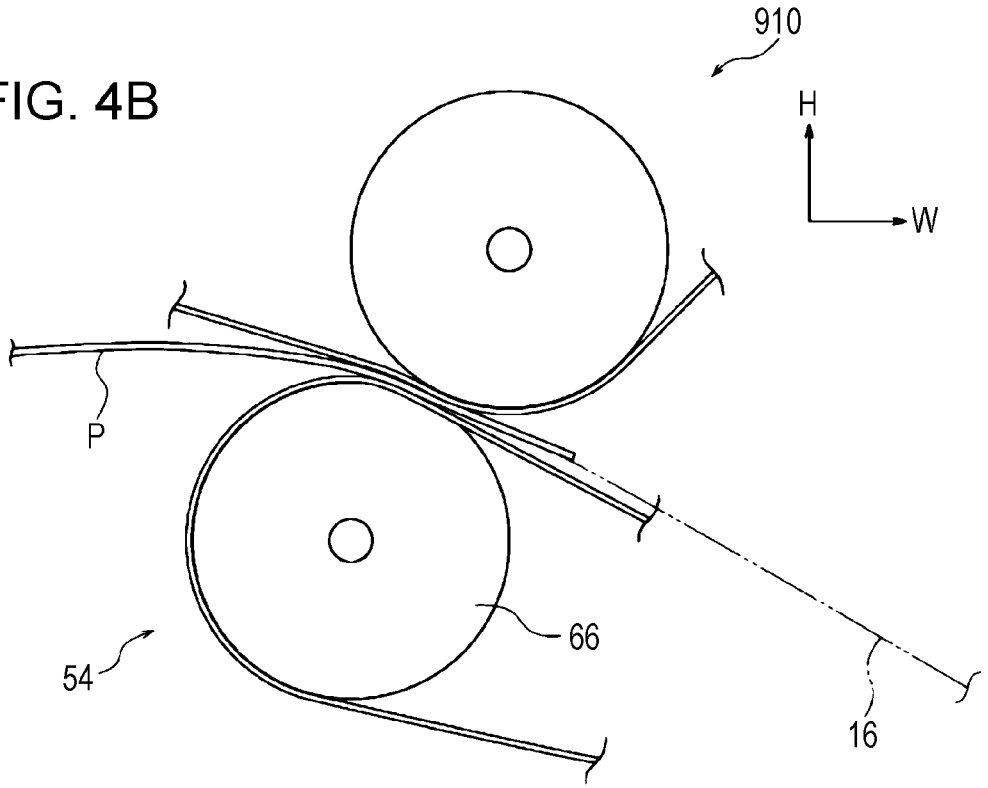
Figure 5:
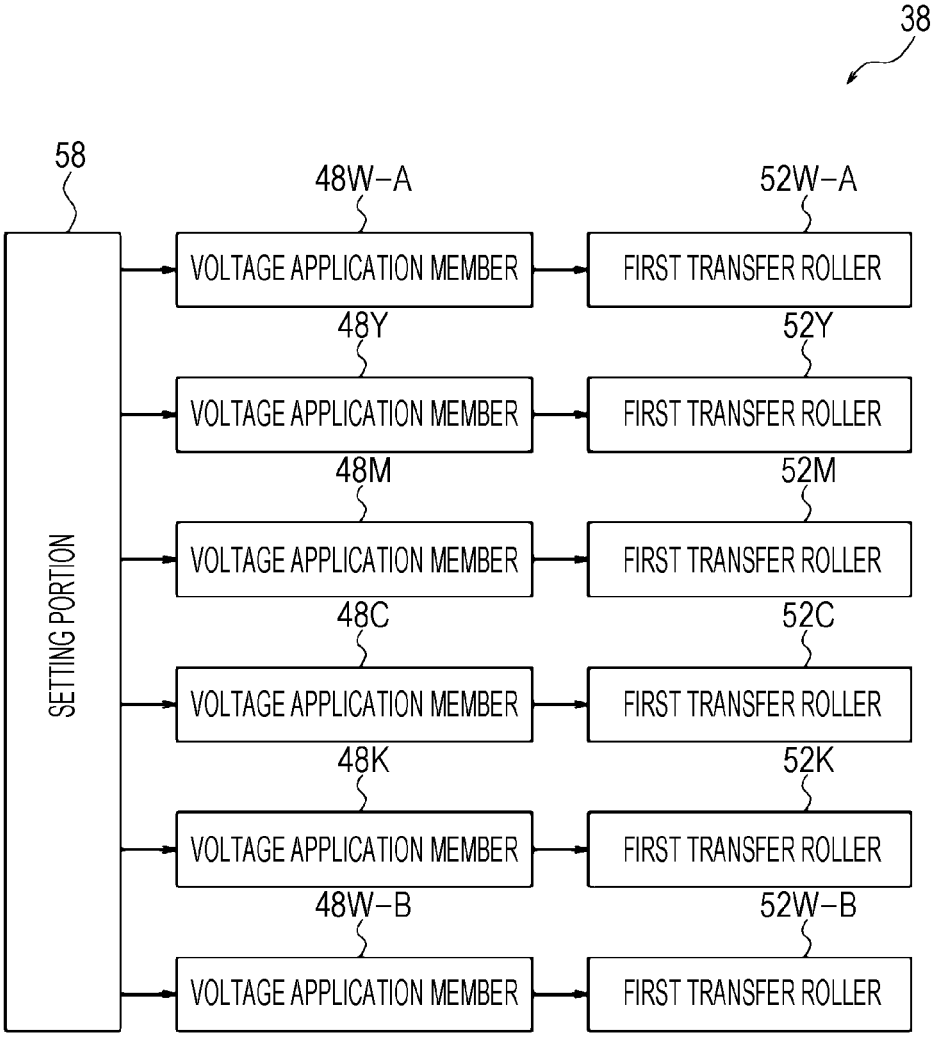
FIG. 5 is a block diagram of a setting configuration of a setting portion of the image forming apparatus according to the first exemplary embodiment of the present invention.

As illustrated in FIG. 3A, a sheet member P is transported toward a pressing portion (nip portion) formed between the roller 32B and the second transfer portion 54. As illustrated in FIGS. 3B and 4A, when the leading end of the transported sheet member P hits the pressing portion or a portion narrowed between the transfer belt 50 and the elastic belt 64, the leading end portion of the sheet member P is bent and collides with the transfer belt 50 (portion E in FIG. 4A). This collision vibrates the transfer belt 50 and scatters part of the W toner on the transfer belt 50, and the scattering toner adheres to the rotating transfer belt 50 again. Thus, the output image formed on the sheet member P by the second transfer portion 54 degrades its quality. As illustrated in FIG. 4B, the sheet member P having its leading end portion temporarily bent is transported while being held between the transfer belt 50 and the second transfer portion 54 and while being pressed against the transfer belt 50.

Now, the reason why only the W toner scatters in the image forming apparatus 910 is considered.

Figure 6:
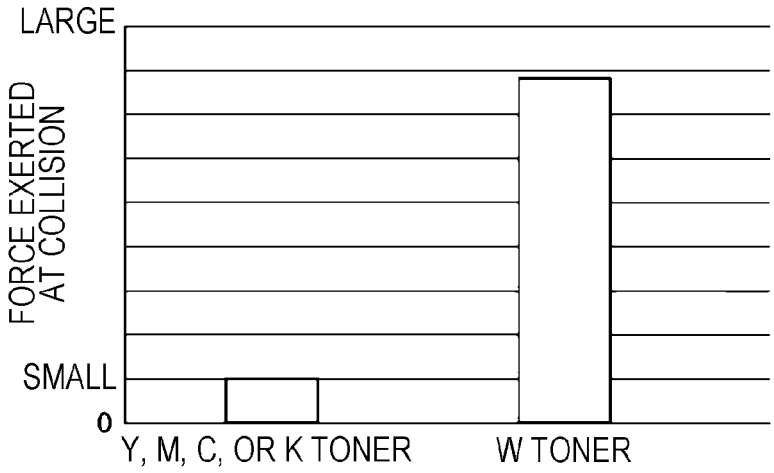
FIG. 6 is a graph of evaluation results for a white toner and a color toner used in the image forming apparatus according to the first exemplary embodiment of the present invention.

FIG. 6 illustrates a force exerted on each toner when the transfer belt 50 vibrates. The same vibration (acceleration) exerts a larger force on the W toner having a large mass than a force on the Y, M, C, and K toners having a small mass. This is probably the reason why part of the W toner on the transfer belt 50 scatters while the Y, M, C, and K toners on the transfer belt 50 do not scatter.

In the image forming apparatus 10, on the other hand, the setting portion 58 sets the voltage application members 48W-A and 48W-B so that a transfer voltage applied to the first transfer roller 52W-B is larger than a transfer voltage applied to the first transfer roller 52W-A.

Thus, in the image forming apparatus 10, the amount of electric charges of the toner of the W toner layer transferred by the first transfer roller 52W-B is larger than the amount used in the image forming apparatus 910. In other words, in the image forming apparatus 10, adhesive power with which the W toner layer transferred to the transfer belt 50 by the first transfer roller 52W-B adheres to the transfer belt 50 is stronger than in the case of the image forming apparatus 910.

The image forming apparatus 10 has stronger adhesive power with which the W toner layer transferred to the transfer belt 50 by the first transfer roller 52W-B adheres to the transfer belt 50. Thus, scattering of the W toner on the transfer belt 50 is suppressed compared to the case of the image forming apparatus 910.

In the image forming apparatus 10, suppressing the scattering of the W toner on the transfer belt 50 reduces the quality degradation of the images transferred to the sheet member P compared to the case of the image forming apparatus 910.

In the image forming apparatus 10, the setting portion 58 sets the voltage application members 48W-A and 48W-B so that the third amount of electric charges is substantially equal to the fourth amount of electric charges when the setting portion 58 sets the first amount of electric charges to be larger than the second amount of electric charges.

As described above, the third amount of electric charges is the amount of electric charges of the toner of the W toner layer immediately before the W toner layer (base layer) located uppermost on the transfer belt 50 and transferred to the transfer belt 50 by the first transfer roller 52W-B is transferred to the sheet member P by the transfer portion 14. As described above, the fourth amount of electric charges is the amount of electric charges of the toner of the W toner layer immediately before the W toner layer (base layer) transferred to the transfer belt 50 by the first transfer roller 52W-A is transferred to the sheet member P by the transfer portion 14.

When a paper medium is used as the sheet member P, the W toner layer, the K toner layer, the C toner layer, the M toner layer, and the Y toner layer are superposed in this order on the sheet member P, which is a paper medium (see FIG. 8A). This W toner layer is a toner layer transferred to the transfer belt 50 by the first transfer roller 52W-B and then transferred to the sheet member P by the second transfer portion 54. Specifically, the amount of electric charges of the toner of the W toner layer immediately before being transferred to the sheet member P is the third amount of electric charges.

Figure 8B:
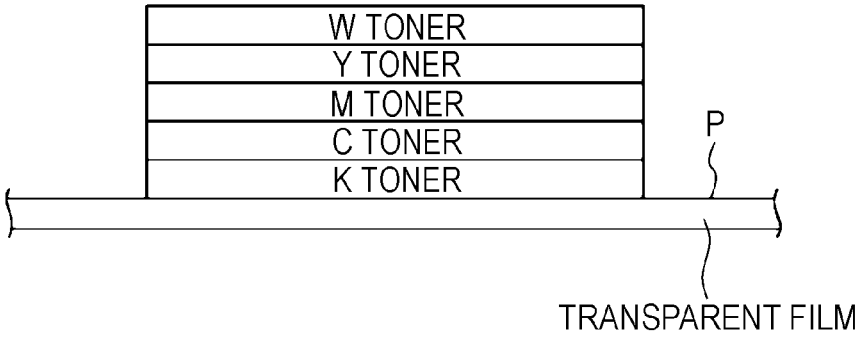

On the other hand, when a transparent film is used as the sheet member P, the K toner layer, the C toner layer, the M toner layer, the Y toner layer, and the W toner layer are superposed in this order on the sheet member P, which is a film (see FIG. 8B). The W toner layer is a toner layer transferred to the transfer belt 50 by the first transfer roller 52W-A and then transferred to the sheet member P by the second transfer portion 54. Specifically, the amount of electric charges of the toner of the W toner layer immediately before being transferred to the sheet member P is the fourth amount of electric charges.

Here, the third amount of electric charges and the fourth amount of electric charges are substantially equal to each other. Thus, the hue of the W toner layer transferred by the first transfer roller 52W-B and then transferred to the sheet member P and the hue of the W toner layer transferred by the first transfer roller 52W-A and then transferred to the sheet member P are substantially equal to each other, unlike in the case where the third amount of electric charges and the fourth amount of electric charges differ from each other. Specifically, the hues match each other when the amounts of electric charges of toners are substantially equal to each other.

Thus, the hue of the toner image reproduced by using a paper medium as the sheet member P and the hue of the toner image reproduced by using a transparent film as the sheet member P approximate each other, compared to the case where the third amount of electric charges and the fourth amount of electric charges differ from each other.

Second Embodiment

Examples of a transfer device and an image forming apparatus according to a second exemplary embodiment of the present invention are described with reference to FIGS. 17 to 22B. Here, portions of the second exemplary embodiment that differ from those of the first exemplary embodiment are mostly described.

Figure 17:
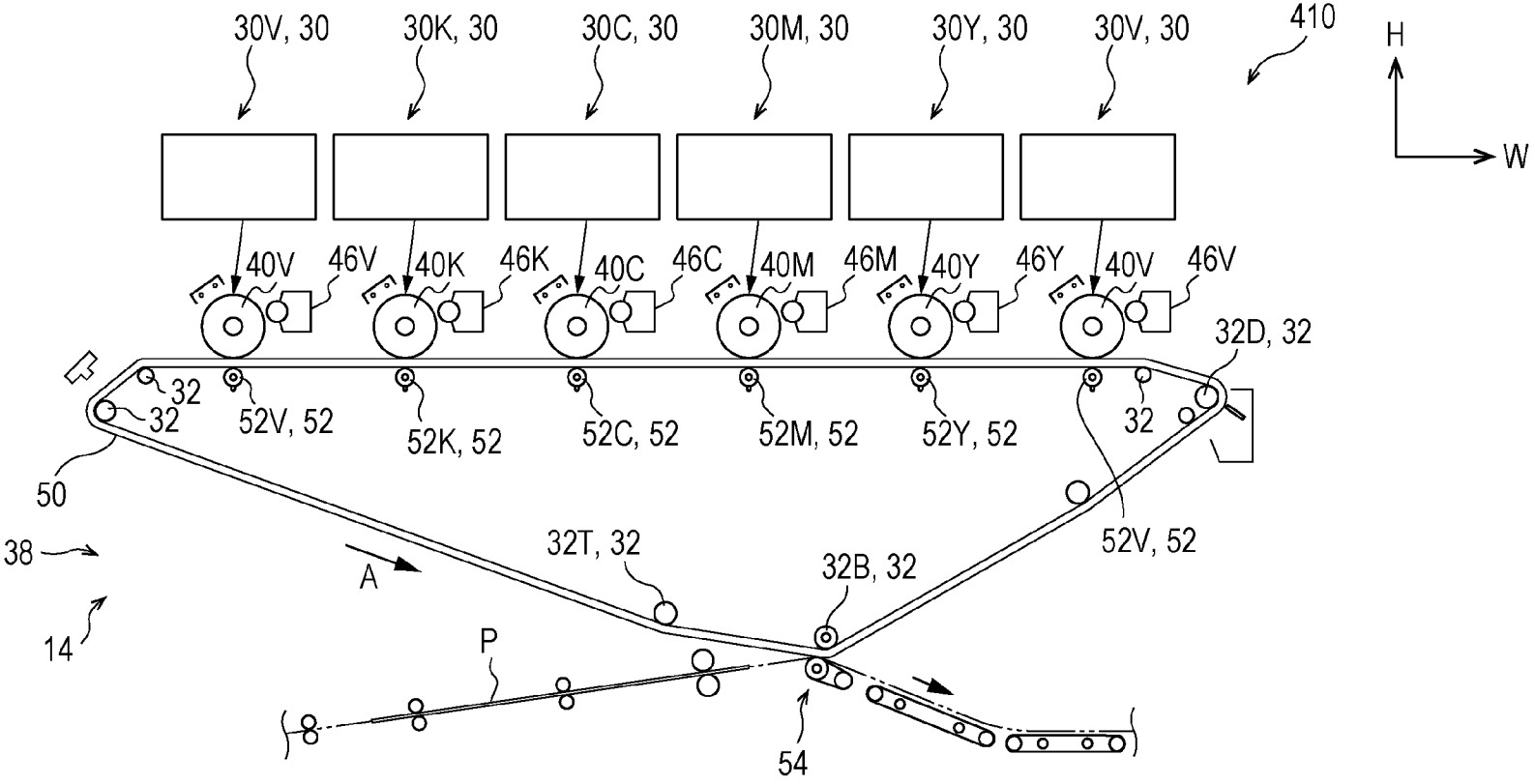
FIG. 17 illustrates a structure of, for example, a toner layer forming portion of an image forming apparatus according to a second exemplary embodiment of the present invention.

As illustrated in FIG. 17, an image forming apparatus 410 according to the second exemplary embodiment includes toner layer forming portions 30 for five colors of yellow (Y), magenta (M), cyan (C), black (K), and silver (V). Two toner layer forming portions 30 are provided for silver (V). The toner layer forming portions 30 for silver (V), yellow (Y), magenta (M), cyan (C), black (K), and silver (V) are arranged side by side in the horizontal direction in this order from the upstream side in the rotation direction of the transfer belt 50 (see arrow A in FIG. 17).

Silver Toner 100

A silver toner 100 (hereinafter may be referred to as "V toner") is used in a developing device 46V for the toner layer forming portion 30V.

Figure 20:
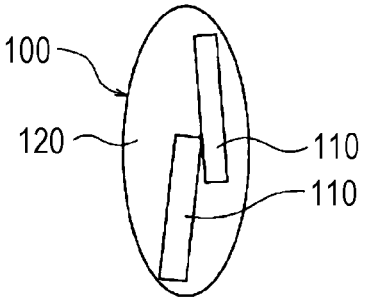
FIG. 20 is a schematic diagram of a silver toner used in the image forming apparatus according to the second exemplary embodiment of the present invention.

As illustrated in FIG. 20, the silver toner 100 (flat toner) contains a flat pigment 110 and a binding resin 120. The flat pigment 110 is formed from aluminum (an example of metal). A known resin material is used as the binding resin 120, and the binding resin 120 has lower electric conductivity than the flat pigment 110.

Figure 21A:
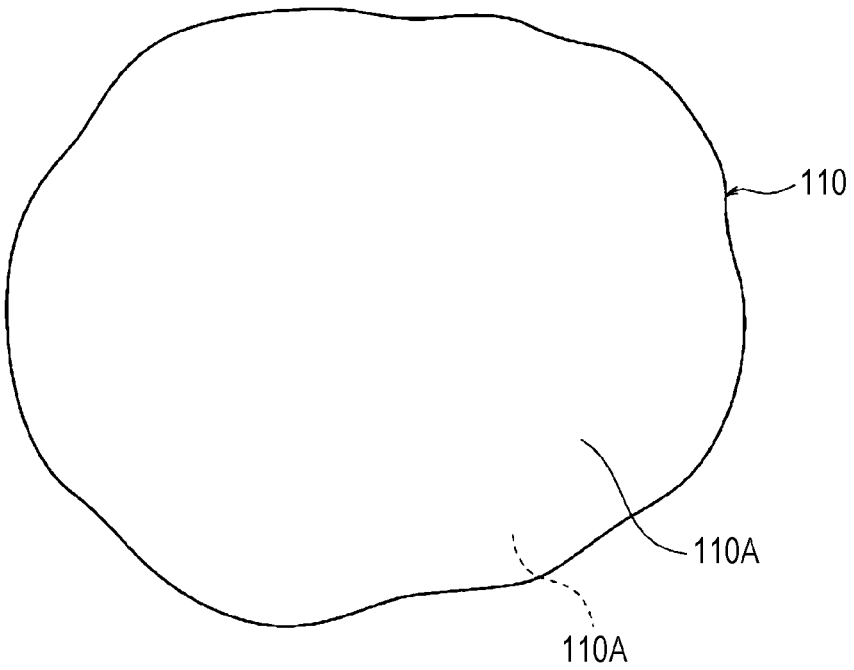
FIGS. 21A and 21B are schematic diagrams of a pigment of a silver toner used in the image forming apparatus according to the second exemplary embodiment of the present invention.
Figure 21B:
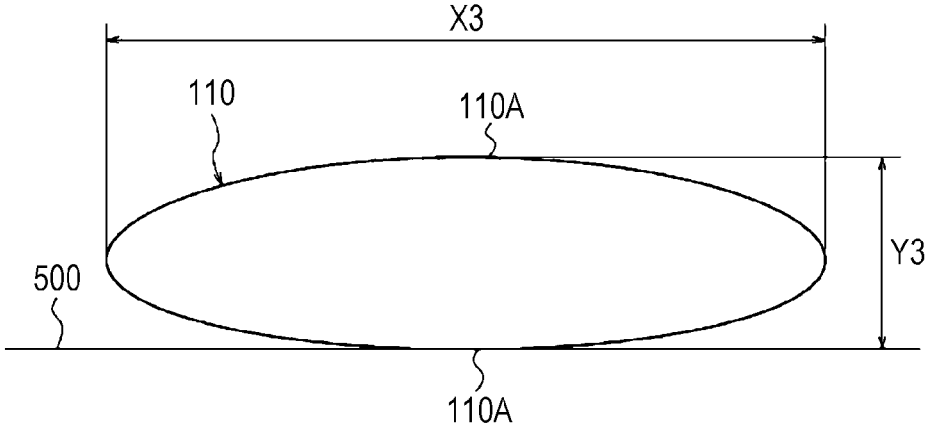

As illustrated in FIG. 21B, when the flat pigment 110 is placed on the flat surface 500 and viewed from the side, the flat pigment 110 has a dimension X3 in the lateral direction that is longer than a dimension Y3 in the vertical direction.

When the flat pigment 110 illustrated in FIG. 21B is viewed from the top, the flat pigment 110 spreads widely as illustrated in FIG. 21A unlike when viewed from the side. The flat pigment 110 has a pair of reflection surfaces 110A facing upward and downward when the flat pigment 110 is placed on the flat surface 500 (see FIG. 21B). As described above, the flat pigment 110 has a flat shape.

Since the flat pigment 110 has a flat shape, the silver toner 100 containing the flat pigment 110 also has a flat shape, following the contour of the flat pigment 110. Thus, when the silver toner 100 is placed on the flat surface 500 and viewed from the side, the silver toner 100 has a dimension A3 in the lateral direction longer than the dimension C3 in the vertical direction, as illustrated in FIG. 22B.

Figure 22A:
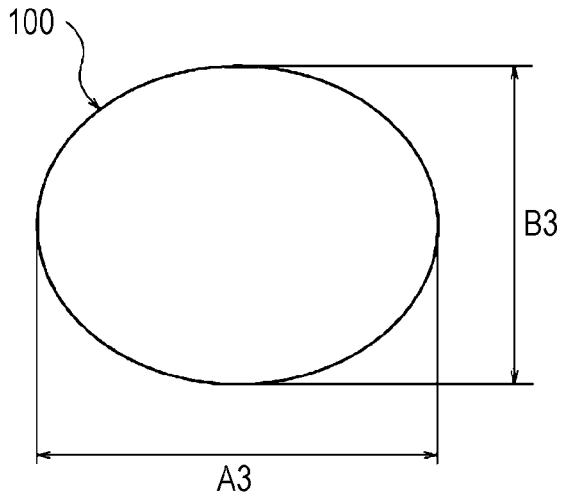
FIGS. 22A and 22B are schematic diagrams of a silver toner used in the image forming apparatus according to the second exemplary embodiment of the present invention.
Figure 22B:
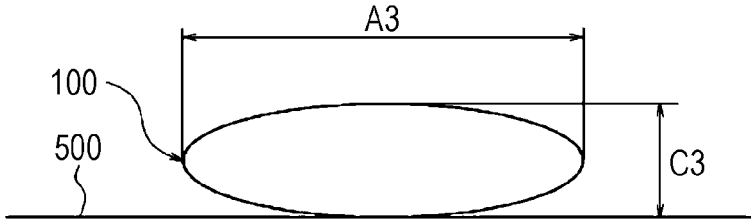

When the silver toner 100 illustrated in FIG. 22B is viewed from the top, the silver toner 100 spreads widely to have a substantially circular shape (substantially elliptic shape) as illustrated in FIG. 22A, unlike when viewed from the side.

Here, the relationship A3≥B3>C3 holds true, where A3 denotes the maximum length (maximum diameter) of the silver toner 100 viewed from the top, B3 denotes an orthogonal length orthogonal to the maximum length A3, and C3 denotes a thickness of the silver toner 100 viewed from the top (dimension in the vertical direction).

In the present exemplary embodiment, an example used as the V toner has a specific gravity of 1.6 g/cm$^3$, a maximum length A3 of 12 μm, an orthogonal length B3 of 12 μm, and a thickness C3 of 2 μm. Thus, the V toner (toner particle) has a mass of $0.24\times10^{-9}$ g. Specifically, the mass of the V toner exceeds the threshold ($0.2\times10^{-9}$ g).

The maximum length A3, the orthogonal length B3, and the thickness C3 are obtained by observing the toner in an enlarged manner using a color laser microscope "VK-9700" (from KEYENCE CORPORATION) and by calculating the maximum length of the toner flat surface using image processing software.

The silver toner 100 is used as a base coat for the non-white colors on the sheet member P. Specifically, the solid layer (solid image) of the silver toner 100 is formed on the sheet member P as a base coat for the non-white colors to provide glossiness to the toner image.

Figure 19A:
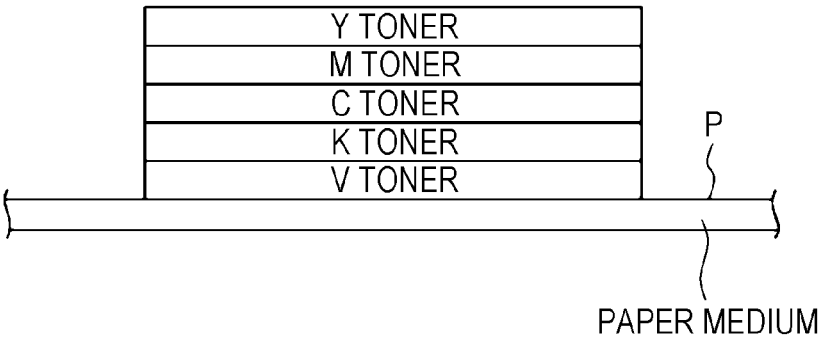
FIGS. 19A and 19B are schematic diagrams of a toner layer superposed on a sheet member used in the image forming apparatus according to the second exemplary embodiment of the present invention.
Figure 19B:
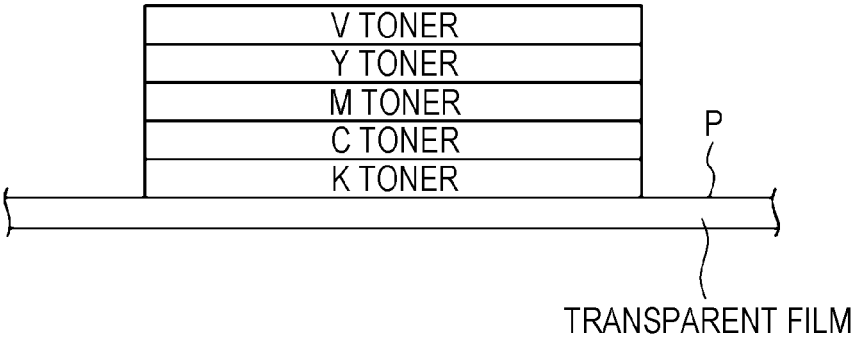

Thus, when the sheet member P is a paper medium, the V toner layer, the K toner layer, the C toner layer, the M toner layer, and the Y toner layer are superposed in this order on the sheet member P, which is a paper medium (see FIG. 19A). On the other hand, when the sheet member P is a transparent film, the K toner layer, the C toner layer, the M toner layer, the Y toner layer, and the V toner layer are superposed in this order on the sheet member P to allow the image viewable through the film (see FIG. 19B).

A case is described where this structure forms, on a paper medium serving as the sheet member P, a toner image including a V toner layer for use as a base coat for the Y, M, C, and K color toners 300 to enhance the image glossiness.

Figure 18:
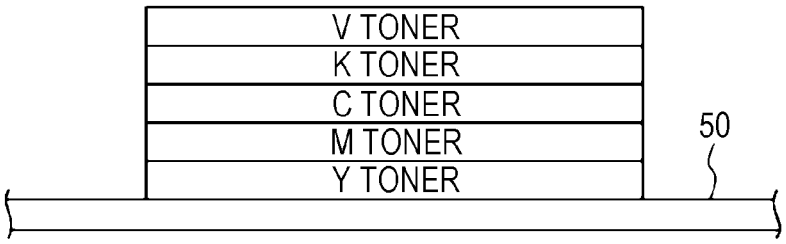
FIG. 18 is a schematic diagram of a toner layer superposed on a transfer belt of the image forming apparatus according to the second exemplary embodiment of the present invention.

Toner layers formed by the toner layer forming portions 30Y, 30M, 30C, 30K, and 30V are first-transferred to the rotating transfer belt 50 by the first transfer rollers 52 (FIG. 17). As illustrated in FIG. 18, a toner image obtained by superposing the Y toner layer, the M toner layer, the C toner layer, the K toner layer, and the V toner layer in this order is formed (held) on the transfer belt 50.

Here, the uppermost one of the toner layers disposed on the transfer belt 50 and constituting the toner images is the V toner layer.

Thus, the setting portion 58 sets the voltage application members 48W-B and 48W-A so that a transfer voltage to the first transfer roller 52W-B is larger than a transfer voltage applied to the first transfer roller 52W-A.

Other operations are the same as those in the case of the first exemplary embodiment.

Third Embodiment

Figure 23:
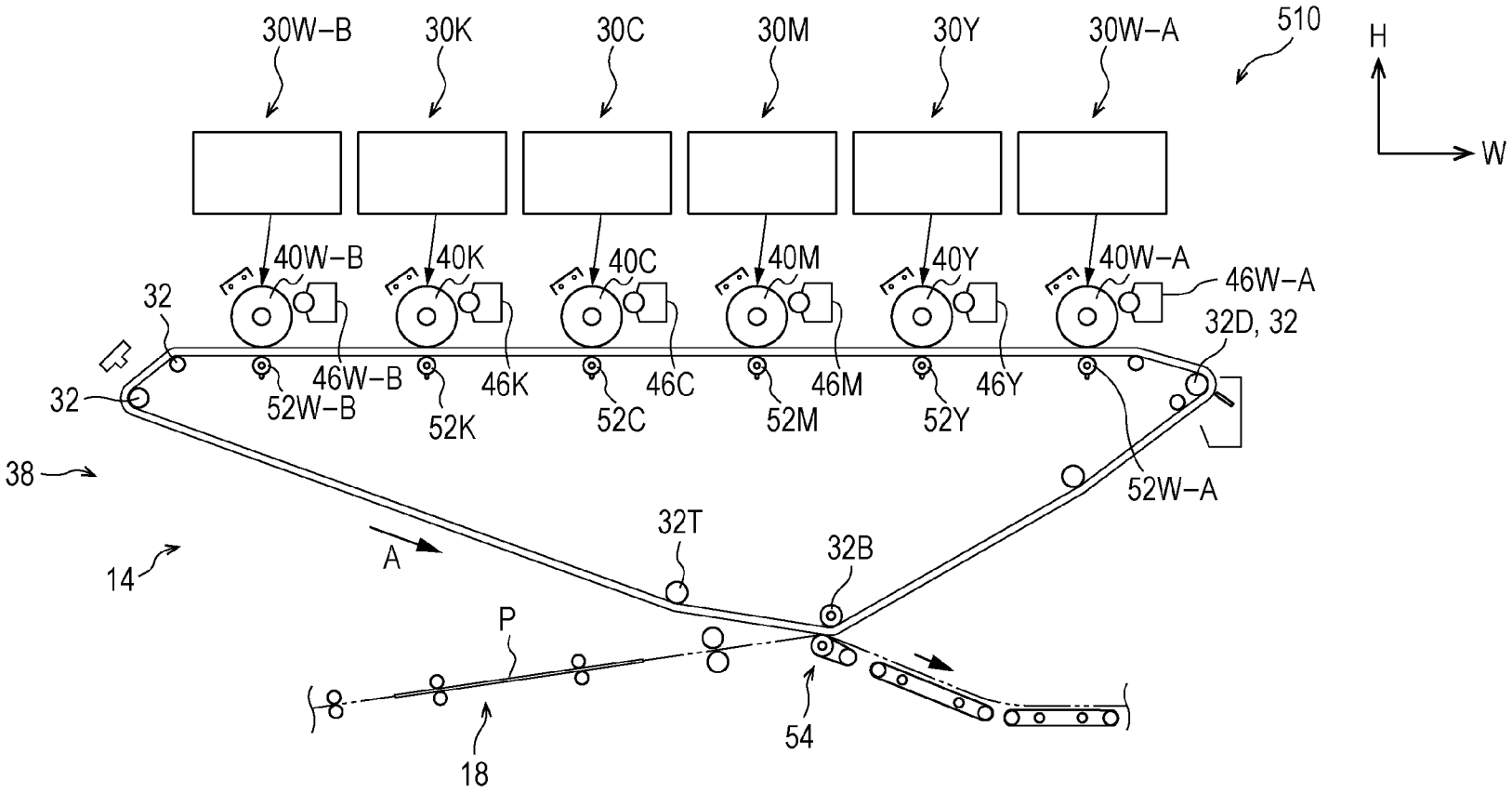
FIG. 23 illustrates a structure of, for example, a toner layer forming portion of an image forming apparatus according to a third exemplary embodiment of the present invention.

Examples of a transfer device and an image forming apparatus according to a third exemplary embodiment of the present invention are described with reference to FIGS. 23 and 24. Portions of the third exemplary embodiment that differ from those of the first exemplary embodiment are mostly described.

Figure 24:
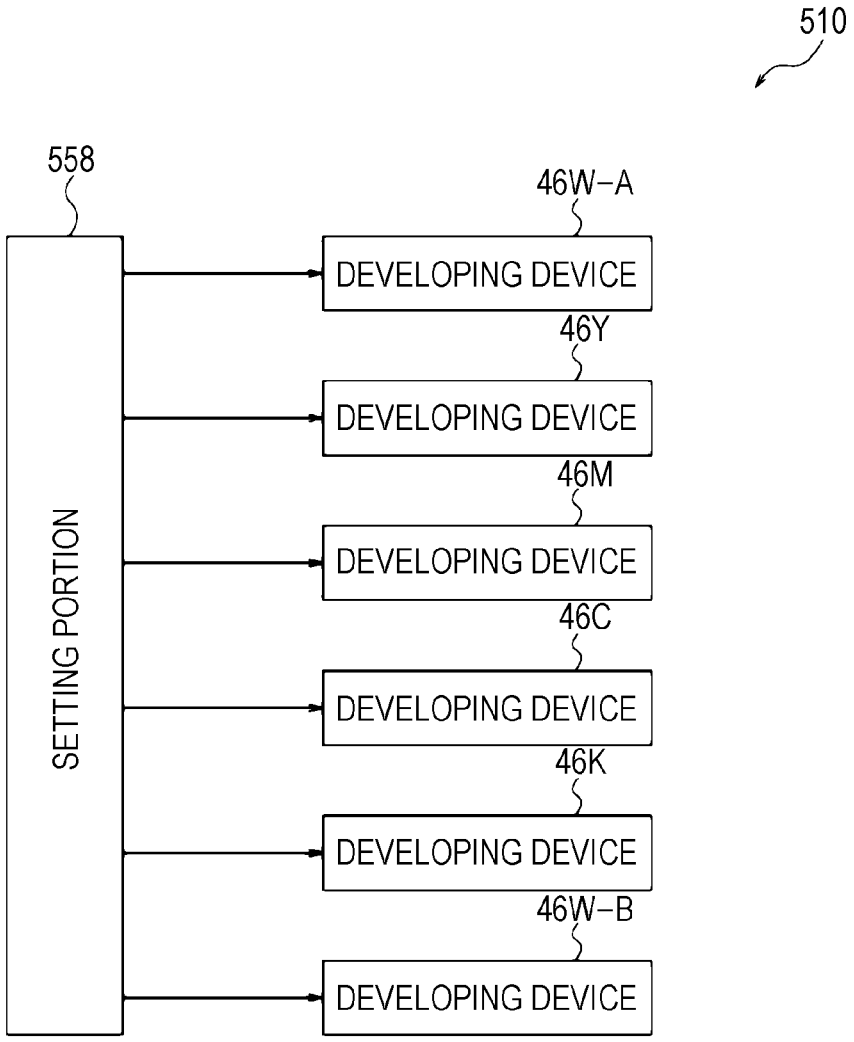
FIG. 24 is a block diagram of a setting configuration of a setting portion of an image forming apparatus according to a comparative example, compared with the image forming apparatus according to the third exemplary embodiment of the present invention.

As illustrated in FIG. 24, an image forming apparatus 510 according to a third exemplary embodiment includes a setting portion 558. The setting portion 558 sets the developing devices 46 that develop electrostatic latent images formed on the image carriers 40 (see FIG. 23) with the developers G containing toner into toner layers.

The setting portion 558 sets the developing devices 46W-A and 46W-B so that the first amount of electric charges is larger than the second amount of electric charges. Specifically, the setting portion 558 sets the developing devices 46W-A and 46W-B so that the amount of electric charges of the toner used for developing an electrostatic latent image formed on the image carrier 40W-B is larger than the amount of electric charges of the toner used for developing an electrostatic latent image formed on the image carrier 40W-A.

The image carrier 40W-A is an example of a second image carrier, and the image carrier 40W-B is an example of a first image carrier. The electrostatic latent image formed on the image carrier 40W-A is an example of a second latent image. The electrostatic latent image formed on the image carrier 40W-B is an example of a first latent image. The developing device 46W-A is an example of a second developing device, and the developing device 46W-B is an example of a first developing device.

More specifically, the setting portion 558 sets a number of times of rotation of an agitation auger (member that agitates a developer G to frictionally charge a toner), which is disposed in the developing device 46W-B to agitate the toner and a carrier, to be larger than the number of times of rotation of an agitation auger, which is disposed in the developing device 46W-A. The agitation augers are not illustrated. Thus, the setting portion 558 sets the amount of electric charges of the toner for developing an electrostatic latent image formed on the image carrier 40W-B to be larger than the amount of electric charges of the toner for developing an electrostatic latent image formed on the image carrier 40W-A.

In the image forming apparatus 510, the setting portion 558 sets the developing devices 46W-A and 46W-B so that the above-described third amount of electric charges is substantially equal to the fourth amount of electric charges.

Other effects are the same as those of the first exemplary embodiment.

Although specific exemplary embodiments of the present invention are described in detail, the present invention is not limited to these exemplary embodiments. It is clear to persons having ordinary skill in the art that the present invention may be embodied in various other exemplary embodiments within the scope of the present invention. For example, in the above-described exemplary embodiments, each of the setting portions 58 and 558 sets the first amount of electric charges to be larger than the second amount of electric charges when the mass of the toner of the W toner layer (base layer) transferred by the first transfer roller 52W-B and the mass of the toner of the W toner layer (base layer) transferred by the first transfer roller 52W-A are equal to or exceeds the threshold. Alternatively, each of the setting portions 58 and 558 may set the first amount of electric charges to be larger than the second amount of electric charges when the toner of the W toner layer (base layer) transferred by the first transfer roller 52W-B and the toner of the W toner layer (base layer) transferred by the first transfer roller 52W-A contain a pigment formed from metal or a metallic oxide. The mass of the toner containing a pigment formed from metal or a metallic oxide is larger than the mass of the color toner 300. Thus, the similar effects described in the exemplary embodiments are exerted here.

In the above-described exemplary embodiment, the volumetric average particle diameter is used to calculate the mass of the white toner 200 or the color toners 300. Instead, the particle diameter averaged by the number of particles may be used to calculate the mass. The particle diameter averaged by the number of particles may be measured by a charge spectrometer (E-Spart ANALYZER) from HOSOKAWA MICRON CORPORATION. This is a measuring device that detects the movement of particles in the aerial vibration field in the electric field by a laser Doppler method and concurrently measures the amount of electric charges and the particle diameter of individual particles from the data. The data of 3000 toner particles are input to this device and the average of the individual particle diameter data is the particle diameter averaged by the number of particles.

In the third exemplary embodiment, the amount of electric charges of the toner is changed by changing the number of times of rotation of an agitation auger. However, the amount of electric charges of the toner may be changed by changing, for example, the carrier of the developer G.

In each of the above-described exemplary embodiment, the present application is described using a tandem image forming apparatus 10 that develops a latent image on a single image carrier 40 with a single developing device 46. Instead, the image forming apparatus 10 may be a revolver (6 cycle) image forming apparatus that develops a latent image on a single image carrier with multiple developing devices.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device, comprising:

a holding body that holds a plurality of layers including a base layer formed of a toner having a mass larger than a threshold, the toner being electrically charged by a charging device;

a transfer body that transfers the layers on the holding body to a recording medium; and a setting portion that sets the charging device so that the charging device electrically charges a toner immediately after being transferred to the holding body with a larger amount of electric charges when the base layer is located uppermost on the holding body, than when the base layer is located other than uppermost on the holding body.

2. The transfer device according to claim 1, further comprising:

a first voltage application member that serves as the charging device that applies a transfer voltage to a first transfer body, which transfers the base layer to the holding body when the base layer is to be located uppermost on the holding body; and a second voltage application member that serves as the charging device that applies a transfer voltage to a second transfer body, which transfers the base layer to the holding body when the base layer is to be located other than uppermost on the holding body, wherein the setting portion sets the first voltage application member and the second voltage application member so that the first voltage application member and the second voltage application member apply a larger transfer voltage to the first transfer body than to the second transfer body.

3. The transfer device according to claim 2, wherein the setting portion sets the charging device so that the charging device electrically charges a toner immediately before being transferred to a recording medium by the transfer body when the base layer is located uppermost on the holding body with an amount of electric charges substantially equal to an amount of electric charges with which a toner immediately before being transferred to a recording medium by the transfer body is electrically charged when the base layer is located other than uppermost on the holding body.

4. The transfer device according to claim 1, further comprising:

a first developing device that serves as the charging device and develops a first latent image with a toner into a base layer located uppermost on the holding body, the first latent image being held on a first image carrier on which an image held by the holding body is formed; and a second developing device that serves as the charging device and develops a second latent image with a toner into a base layer located other than uppermost on the holding body, the second latent image being held on a second image carrier on which an image held by the holding body is formed, wherein the setting portion sets the first developing device and the second developing device so that the first developing device and the second developing device electrically charge a toner with which the first latent image is developed with a larger amount of electric charges than a toner with which the second latent image is developed.

5. The transfer device according to claim 4, wherein the setting portion sets the charging device so that the charging device electrically charges a toner immediately before being transferred to a recording medium by the transfer body when the base layer is located uppermost on the holding body with an amount of electric charges substantially equal to an amount of electric charges with which a toner immediately before being transferred to a recording medium by the transfer body is electrically charged when the base layer is located other than uppermost on the holding body.

6. The transfer device according to claim 1, wherein the setting portion sets the charging device so that the charging device electrically charges a toner immediately before being transferred to a recording medium by the transfer body when the base layer is located uppermost on the holding body with an amount of electric charges substantially equal to an amount of electric charges with which a toner immediately before being transferred to a recording medium by the transfer body is electrically charged when the base layer is located other than uppermost on the holding body.

7. An image forming apparatus, comprising:

the transfer device according to claim 1; and an image forming unit that forms a toner image held on the holding body of the transfer device.

8. A transfer device, comprising:

a holding body that holds a plurality of layers including a base layer formed of a toner containing a pigment formed of metal or a metallic oxide, the toner being electrically charged by a charging device;

a transfer body that transfers the layers on the holding body to a recording medium; and a setting portion that sets the charging device so that the charging device electrically charges a toner immediately after being transferred to the holding body with a larger amount of electric charges when the base layer is located uppermost on the holding body, than when the base layer is located other than uppermost on the holding body.

9. The transfer device according to claim 8, further comprising:

a first voltage application member that serves as the charging device that applies a transfer voltage to a first transfer body, which transfers the base layer to the holding body when the base layer is to be located uppermost on the holding body; and a second voltage application member that serves as the charging device that applies a transfer voltage to a second transfer body, which transfers the base layer to the holding body when the base layer is to be located other than uppermost on the holding body, wherein the setting portion sets the first voltage application member and the second voltage application member so that the first voltage application member and the second voltage application member apply a larger transfer voltage to the first transfer body than to the second transfer body.

10. The transfer device according to claim 9, wherein the setting portion sets the charging device so that the charging device electrically charges a toner immediately before being transferred to a recording medium by the transfer body when the base layer is located uppermost on the holding body with an amount of electric charges substantially equal to an amount of electric charges with which a toner immediately before being transferred to a recording medium by the transfer body is electrically charged when the base layer is located other than uppermost on the holding body.

11. The transfer device according to claim 8, further comprising:

a first developing device that serves as the charging device and develops a first latent image with a toner into a base layer located uppermost on the holding body, the first latent image being held on a first image carrier on which an image held by the holding body is formed; and a second developing device that serves as the charging device and develops a second latent image with a toner into a base layer located other than uppermost on the holding body, the second latent image being held on a second image carrier on which an image held by the holding body is formed, wherein the setting portion sets the first developing device and the second developing device so that the first developing device and the second developing device electrically charge a toner with which the first latent image is developed with a larger amount of electric charges than a toner with which the second latent image is developed.

12. The transfer device according to claim 11, wherein the setting portion sets the charging device so that the charging device electrically charges a toner immediately before being transferred to a recording medium by the transfer body when the base layer is located uppermost on the holding body with an amount of electric charges substantially equal to an amount of electric charges with which a toner immediately before being transferred to a recording medium by the transfer body is electrically charged when the base layer is located other than uppermost on the holding body.

13. The transfer device according to claim 8, wherein the setting portion sets the charging device so that the charging device electrically charges a toner immediately before being transferred to a recording medium by the transfer body when the base layer is located uppermost on the holding body with an amount of electric charges substantially equal to an amount of electric charges with which a toner immediately before being transferred to a recording medium by the transfer body is electrically charged when the base layer is located other than uppermost on the holding body.

* * * * *